United States Patent [19]

Rollins

[11] 4,240,669

[45] Dec. 23, 1980

[54] MINING CUTTER BIT HOLDER AND MOUNTING ASSEMBLIES

[75] Inventor: Lester G. Rollins, Sandy Lake, Pa.

[73] Assignee: Joy Manufacturing Company, Pittsburgh, Pa.

[21] Appl. No.: 947,367

[22] Filed: Oct. 2, 1978

[51] Int. Cl.[3] ..... E21C 25/12

[52] U.S. Cl. ..... 299/86; 299/91

[58] Field of Search ..... 299/91, 93, 86

[56] References Cited

U.S. PATENT DOCUMENTS

| | | | |
|---|---|---|---|
| 3,397,012 | 8/1968 | Krekeler | 299/86 |
| 3,498,677 | 3/1970 | Morrow | 299/86 |
| 3,519,309 | 7/1970 | Engle et al. | 299/86 |
| 3,830,546 | 8/1974 | Kniff | 299/86 |
| 3,992,061 | 11/1976 | Rollins | 299/93 |

*Primary Examiner*—William F. Pate, III

*Attorney, Agent, or Firm*—George Patrick Baier

[57] ABSTRACT

A mining cutter bit holder and mounting assembly providing for positive engagement of the load bearing surfaces between the holder and mounting base. The bit holder and mounting base cooperate to support the bit against lateral forces and inhibit rotation of the holder within the socket in the base. Load support surfaces are arranged so that as the bit holder is clamped in the base and positive contact is made between surfaces. Bit support surfaces are provided at the front and rear of the bit holder.

72 Claims, 13 Drawing Figures

MINING CUTTER BIT HOLDER AND MOUNTING ASSEMBLIES

BACKGROUND OF THE INVENTION

In mining operation a driven element or bit is used to dislodge the bedded material such as for example coal. Because of the forces on the bit and the abrasiveness of its contact with the material, bits are subject to high wear and must be replaced at periodic intervals in the mining operation. It is therefore desirable to have a means for attaching the bit to the mining equipment that is secure and which allows for easy bit replacement. One solution has been to have a two piece means for attaching the bit, a base piece and a holder piece. A base piece is securely attached to the mining apparatus, such as for example by welding such a base piece to the rotating drum of a continuous miner. Such a base piece may have a socket therein adapted to receive a holder piece. The holder piece is adapted to receive the bit and to be readily replaceable in the base piece as this holder piece is also subject to wear during normal operation. Such a system of bit, holder, and base allow each component to be replaced independently and with an ease of replacement generally proportionate to its expected life.

In the past two approaches to solving the problems of durability and replaceability in cutter bit attachment have been developed. The first approach has been to use large steel mounting blocks and heavy lug type bit holders. The heavy lug is either pinned or bolted to the block to secure the two portions. While this type of lug and block arrangement solve some of the problems inherent in bit attachment, the basic approach is strength through sheer physical size. This solution naturally results in a large block and lug with corresponding high manufacturing costs and unnecessary weight. Since this approach has placed paramount emphasis on size to resist the primary cutting forces it has not addressed itself to the problem of movement between the lug and mounting block. Such movement between a bit holder and a mounting base can cause unnecessary wear life of the holder and mounting base. This wear results in shortened life of the mounting base and the mining machine driving component, such as for example the cutting drum on a continuous miner. U.S. Pat. No. Re. 28,310 and U.S. Pat. No. 3,697,137 are representative of this large lug and block approach to the problem.

An alternative approach to the problem has been to use a mounting base or block having a central socket. A bit holder having a shank portion is inserted into the socket and clamped in place. This socket type approach generally results in a smaller more efficient bit holder and base assembly. U.S. Pat. Nos. 3,498,677 and 3,992,061 are indicative of this approach. Such socket type designs have concentrated on supporting the bit and bit holder to resist the primary cutting forces by urging the shank portion of the bit holder rearward and downward in the sockets. By use of the holder shank and efficiently designed support surfaces on the bit holder this approach has resulted in a smaller assembly that adequately resists the primary cutting forces. The small size of the socket type bit holder creates another consideration in that the moment arm from the load bearing surfaces to the axis of the shank has been reduced. This reduction in moment arm lessens the effectiveness of the holder and base combination to resist rotation of the holder about the axis of the shank. Rotational torques about the shank axis result in unnecessary wear to both the holder and the bit. This invention provides for resisting these rotational torques and retarding rotational movement of the holder about the central axis of the socket.

Because the base should have a long life, it is usually welded to the mining machine, drum, or chain; and this securing attachment represents little real problems. This invention relates to the attachments of the bit to the holder, and the holder to the base. One such attachment has been the use of a base having a socket therein and a holder having a shank which engages such socket. A clamping means such as for example a bolt is used to secure the shank in the socket. This invention relates to the means by which the bit transmits forces to the holder and the holder in turn transmits forces to the base. Such a socket type base and holder are disclosed in U.S. Pat. No. 3,992,061.

During mining operation the cutter bit is subjected to extremely large mechanical forces of varying magnitude and direction. One such mining operation for example is the use of cutter mounted on a rotating cutter drum of a continuous miner for coal mining. The first of such forces or cutting force on a single cutter bit is generally tangential and varies during a single revolution of the drum from a high cutting force during contact with the coal, to low or negative force when not contacting the coal. The magnitude of this cutting force also varies within a single cutting stroke as the consistency of the coal and its structural arrangement varies.

In addition to the actual cutting force it is necessary to apply a normal pressure against the coal to force the cutter into contact with the face. The second or normal force is quite high during sumping or shearing operations. Again the normal force varies during the cutting stroke depending up the consistency and structure of the coal. This normal force on the bit is generally direct toward the axis of the drum during the cutting stroke. On the second half of drum rotation, after completing the cutting stroke when the bit is not contacting the coal, an outward force and a tangential centrifugal force results due to the drum rotation and the bit support structures.

A third significant force present during cutting operations is a side or lateral thrust generally perpendicular to the plane of the cutting and normal forces described above. This side thrust results from inperfections in the coal, misalignment of the cutter, or side movement of the driving mechanism such as for example cutting clearance with the continuous miner drum. This side force tends to produce rotation of the holder in the socket resulting in assembly failure or poor cutting.

While other forces may be exerted on the cutter assembly during operation such other forces can usually be resolved into components which act similar to the three forces described above. Because of the magnitude and rate of change of these forces it is of prime importance that holder assemblies be capable of supporting the force load and retarding the oscillations and movement associated with such quickly changing loads. When the holder to base connection is given any degree of movement, about the socket axis such movement results in unnecessary wear and premature failure. This invention relates to a cutter assembly that provides support, inhibits movement, and allows for easy removal and replacement of its component parts.

As more support surfaces are added to the bit holder, it becomes increasingly difficult to achieve a proper seating between the bit holder and the bit base. This improper seating is due to a number of causes including manufacturing tolerances, normal wear on the base, and the presence of foreign matter such as, for example, coal dust during a field replacement of a bit holder. The U.S. Pat. No. 3,992,061 explains and solves some of the seating problems. But, the problem existed of how to add load support surfaces which support against the lateral forces in a manner which does not impair the proper seating of the bit holder and base.

Previous holder and base assembly designs concentrated on the ability to sustain the primary cutting force and the normal force. Such designs resulted in holders which through their material bulk restrained some of the side forces; but when such designs are subjected to severe duty having high side loadings the life expectancy is greatly reduced.

While cutter bits may take many shapes, they generally have a conical tip portion that actually engages the material to be mined, and a body portion that is attached to the holder. This invention relates to securing the body portion of the bit to the holder. One such type of bit is a bit having a generally conical tip portion and a shank portion for insertion into a bore in the holder. This invention relates to a means for supporting the bit within the holder.

It is well known that a conical type bit which is relatively free to rotate about the axis of the shank will have a longer bit life and be more effective for cutting operations. For this reason it is desirable to have a bit shank of generally circular cross section which freely rotates within the bore of the bit holder. The problem has been to adequately support the bit against the forces present in the cutting operation and still permit the bit to freely rotate. One method for holding the bit and allowing rotation has included a sloping shoulder on the forward portion of the bit shank which bears upon a recessed surface on the front of the holder. Such a forward shoulder is shown in U.S. Pat. No. 3,499,685. This type of shoulder support requires that the shoulder area transmit the complete axial component of the cutting forces. Such large forces on a small limited area result in wear due to friction.

Another method of supporting the bit includes a rear surface on the bit shank which engages a surface on a portion of the holder. This rear support method simplifies the bit and holder engagement but the bearing surface is limited to the cross sectional area of the bit shaft or shank. U.S. Pat. Nos. 3,397,012 and 3,554,605 show this method of rear bit contact.

SUMMARY OF INVENTION

The invention provides for a cutter holder and base of the socket type which has load bearing surfaces to sustain the cutting and normal forces. In addition, load surfaces are provided to sustain the side forces imposed on the bit and thereby inhibit rotation of the holder within the socket. A forward extension is provided to gain a maximum movement arm about the axis of the holder shank. The forward extension arm is engaged by the base so as to inhibit rotation of the holder within the base. The engagement of the forward extension is such that the holder is free to travel to the rear as the holder is clamped in the socket. Such a rear movement allows for full and complete contact between the load bearing surfaces located on the holder and on the base.

The forward extension has load bearing surfaces on both sides so as to fit into an upwardly open channel. The sides of the channel engage the sides of the forward extension to retard rotational movement between the base and holder about the axis of the socket. In addition, the forward extension has other surfaces that add support forces to counter the cutting and normal forces. The bottom of the forward extension engages the bottom of the channel to provide upward support opposing the normal force on the bit.

In addition to supporting the holder to the base this invention provides for a secure mounting of the bit in the holder. Bits of the type having flanges are used with the flange contacting the forward end of the holder. The invention also provides for support of the bit at the rear of the holder, or for distributing the bit forces on the holder between a front shoulder and a rear support or anvil on the holder.

One object of this invention is to provide an apparatus for securing a cutter bit to a mining apparatus which distributes the mining forces between forward and rearward load bearing surfaces on the bit holder.

Another object is to provide a cutter bit holder and mounting base of the socket type which are readily joined together and which retards or inhibits rotation of the holder about the axis of the socket.

Another object is to provide a cutter bit holder which when clamped in a socket positively contacts all of the forwardly facing load bearing surfaces on the base.

Another object is to provide a base member to engage a portion of the bit holder so as to resist rotation of the holder about its shank axis while allowing limited rearward movement of holder during clamping.

Another object is to provide a cutter holder and base which retard the rotational oscillation between the holder and the base about the common axis.

Another obect is to provide a bit holder which when worn can be readily removed from the base and replaced with a new holder insuring a tight fit between the new holder and the base.

These and other advantages of the present invention will become more apparent upon references to the following detailed specification and drawings.

FIG. *7a* is a side elevational view in partial cross-section of an embodiment of a base, bit holder and base assembly with a holder having a rear tongue and with bit contacting only the front shoulder of the holder.

FIG. *7b* is partial cross section of a side elevational view of an assembly having a base and holder similar to that in FIG. *7a* with a cutter bit contacting the holder at forward and rearward positions.

Figure 7A:
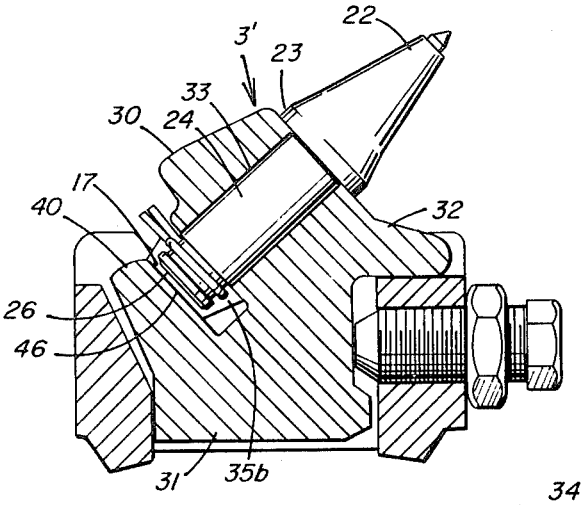
Figure 7B:
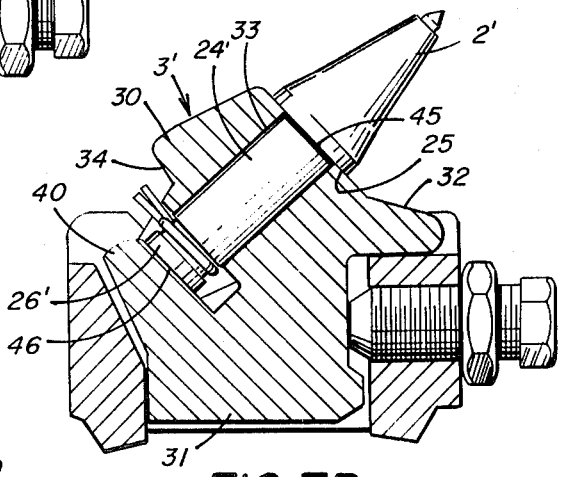
Figure 7C:
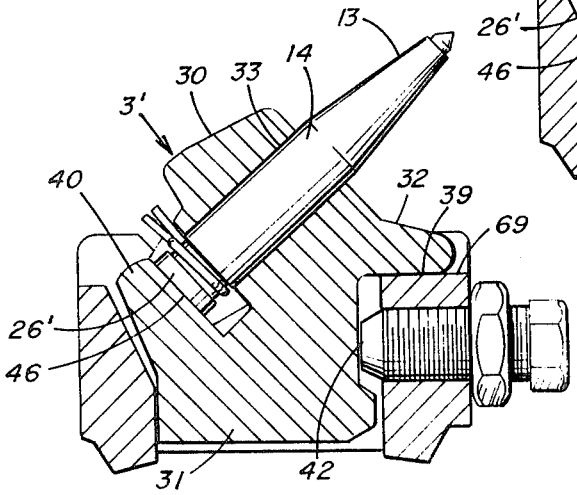

FIG. 7c is a cross section of an assembly having a base and holder similar to that in FIG. 7a with a pencil type cutter bit contacting the tongue portion of the holder.

Figure 8:
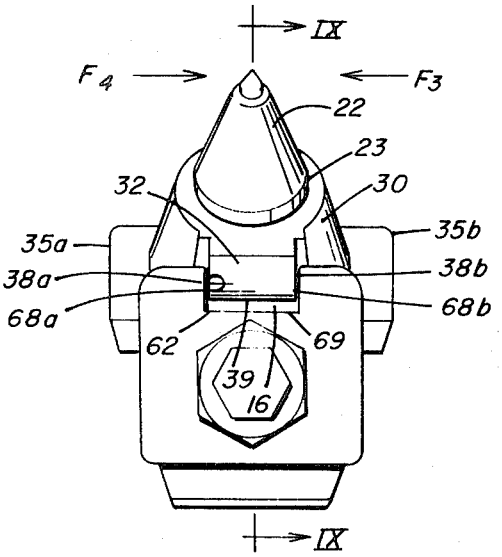

FIG. 8 is a front elevational view of a bit, bit holder, and base assembly with a clearance between the forward extension and the extension support surface of the base.

Figure 9:
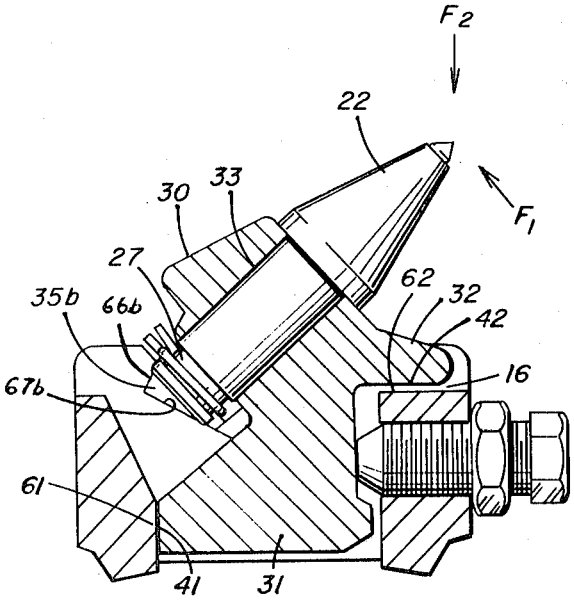

FIG. 9 is a partial cross section of the assembly shown in FIG. 8 taken on line IX.

Figure 2:
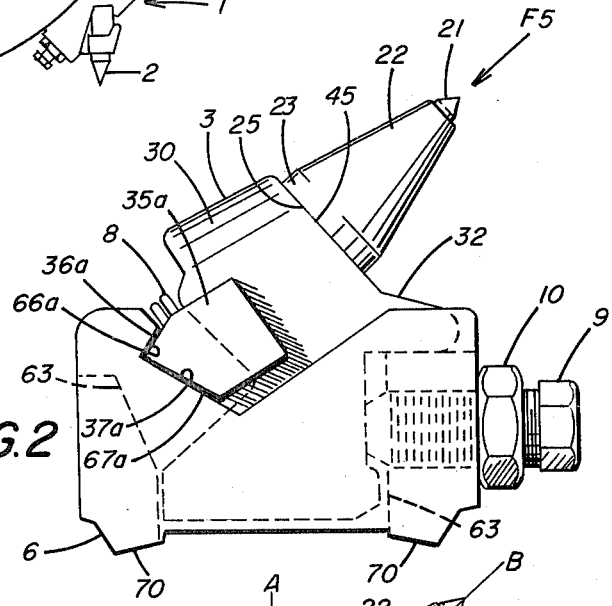
FIG. 2 is a side elevational view of a bit, holder and base assembly, with the holder and bolt shown in partial phantom.
Figure 10:
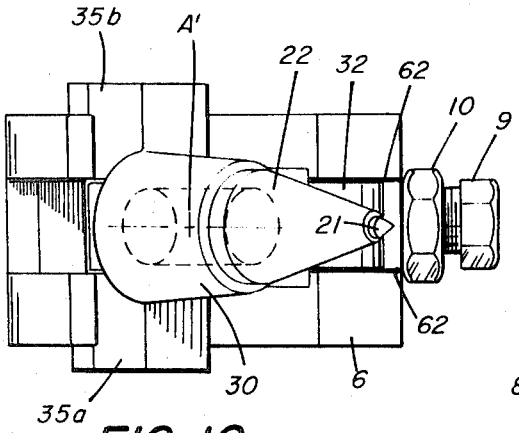

FIG. 10 is a top plan view of the bit, holder and base assembly shown in FIG. 2.

Figure 11:
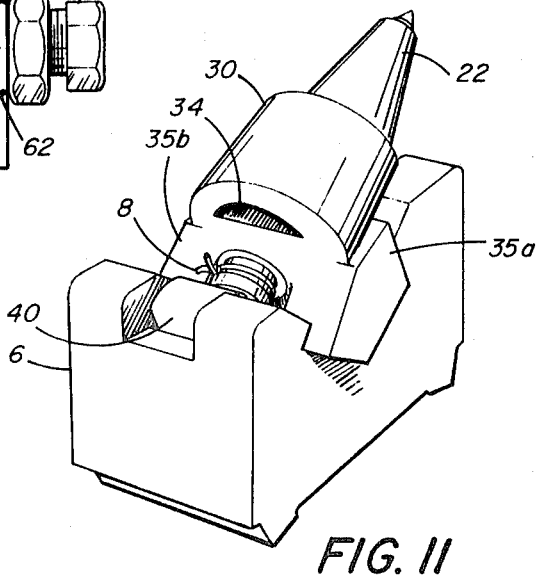

FIG. 11 is a perspective view of the assembly shown in FIG. 2.

DESCRIPTION OF PREFERRED EMBODIMENTS

Figure 1:
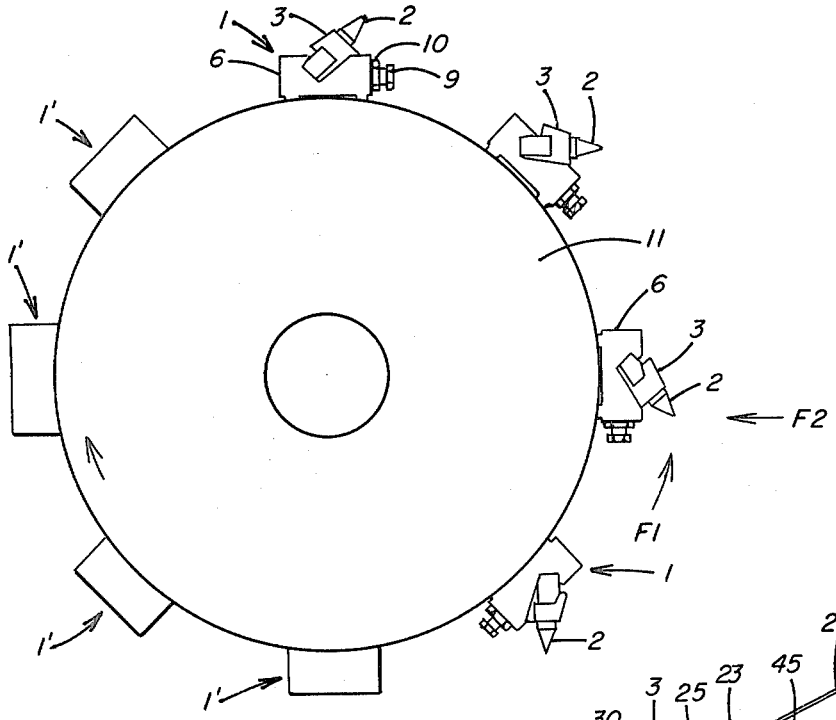
FIG. 1 is an outline of a side view of a miner drum showing the position of eight bit bases, with four base, holder and bit assemblies shown in partial detail.

In the process of mining a metal cutter bit is secured to apparatus which is advanced into contact with a surface to dislodge earth, ore, or other bedded materials. FIG. 1 shows a cross section of a mining drum 11 with a number of cutter bits 2 attached to the periphery. The cutter bit 2 is part of an assembly 1 which is placed in spaced relationship around the drum. The cutter drum 11 shows four bit assemblies 1 and four positions 1' for attachment of additional bit assemblies. It is to be understood that additional bit assemblies can be attached to the drum in varying spaced relationship, and as in the case of a continuous miner additional bit assemblies are attached to the drum along its longitudinal axis. While the bit assemblies shown in FIG. 1 are attached to the drum 11 in a symmetrical relationship it is to be understood that the bit assemblies may be angled or staggered with respect to one another so that the bits engage the mined material at varying angles. Each bit assembly 1 includes a conical bit 2, a bit holder 3, and a base 6. The base 6 is secured to the drum 11 by a known means such as for example welding. The base 6 has a threaded bolt 9 associated with it that provides clamping support to the bit holder 3. The bolt 9 is locked in place by nut 10. The holder 3 has provision for mounting and securing the bit 2. While the bit assemblies 1 are shown mounted on a drum in FIG. 1, it is to be understood that such bit assemblies may be mounted on other mining machines such as for example cutter chains, conical head cutters, shearing machines, or mining heads.

As the drum 11 is rotated in the direction as shown the bit 2 contacts the material to be mined and two primary cutting forces F1 and F2 are exerted on the bit 2. Force F1 is generally parallel to the direction of movement of the bit assembly 1, and as shown in FIG. 1 this movement is tangential to the arc inscribed by the bit during the rotation of the drum 11. The force F2 results from the drum being advanced into the material. F2 is generally acting perpendicular to F1 and generally normal to the surface being mined. While it is shown that forces F1 and F2 act on the uppermost portion of the bit it is to be understood that forces F1 and F2 are representative of similarly directed forces acting upon the complete bit.

The forces F1 and F2 can be considered as a resulting single force F5, as shown in FIG. 2 which acts generally along the axis of the bit 2 and in a direction tending to force the bit 2 into engagement with the holder 3.

Figure 4:
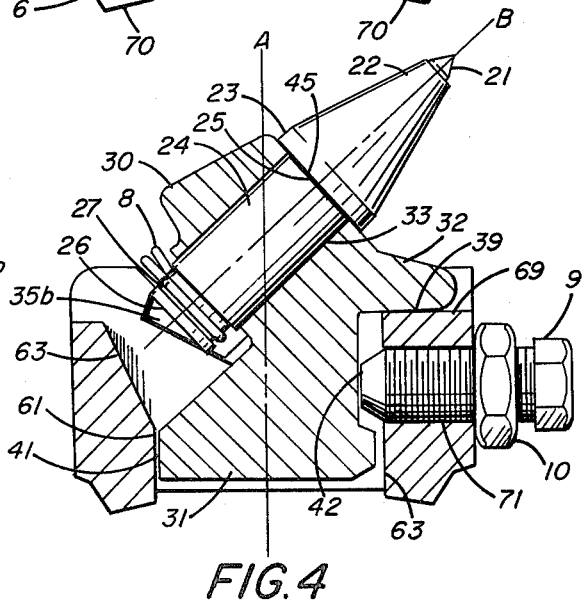
FIG. 4 is a partial cross-sectional view taken along the line IV in FIG. 3.

As shown in FIG. 2 the bit 2 has a top 21 at its uppermost portion and a cone portion 22 extending rearward from the tip. The bit as shown in FIG. 4 has a shaft portion 24 extending from the cone portion 22. To retain the bit within the holder, an annular groove 27 is provided on the rear end of the bit shaft 24. A retaining spring 8 is fitted into the groove 27 so that when the retaining spring 8 is expanded the bit shaft 24 can be inserted or removed from the bit holder 3.

The bit holder 3 includes a holding portion 30, a shank portion 31 and a forward extension portion 32. The holding portion 30 has a bore 33 extending through the holding portion 30. The bit shaft 24 has a circular cross section and is rotatably fitted within the bore 33. As can be seen in FIG. 4 the bit is retained within the bore 33 by the retaining spring 8 on one end of shaft 24 and by the engagement of the flanged area 23 with the holder portion 30. A rearward facing annular surface 25 on the bit flange 23 engages a corresponding annular load bearing surface 45 on the holding portion 30. The engagement of these two surfaces result in forces on the bit directed along the axis B being transmitted to the bit holder.

In the embodiment shown in FIG. 2 it is the engagement of the annular surfaces 45 and 25 that transmits force F5 from the bit to the holder.

The base 6 has an upwardly open socket 63 into which the bit shank portion 31 is inserted. The socket 63 and shank portion 31 provide means for generally aligning and supporting the holder within the base. The primary cutting forces are transmitted from the holder 3 to the base 6 by means of load bearing surfaces on holder engaging corresponding load bearing surfaces on the base 6. The portion 30 of the holder has two rearward extending legs 35a and 35b. Each of these legs has a corresponding upper surface 36a and 36b respectively, and a lower surface 37a and 37b respectively. These load bearing surfaces on the holder legs engage corresponding load bearing surfaces on the base 6. The upper right leg surface 36a engages the upper surface 66a on the base, and the upper surface 36b on the leg engages the upper surface 66b on the base 6. The lower surface 37a on the holder engages the lower surface 67a on base 6, and the lower surface 37b on the holder engages the lower surface 67b on the base 6. These surfaces on the holder legs and their respective surfaces on the base 6 transmit forces resulting from the primary cutting surfaces previously described from the holder 3 to the base 6. It is apparent from the geometry as shown in FIG. 2 that these surfaces effectively transmit forces directed parallel to the axis of the bit, which coincides with the axis of the bore B as shown in FIG. 4.

Referring to FIG. 4 it can be seen that the centerline or axis A of the socket 63 generally coincides to the centerline or axis of the bit holder shank 31. When the bit holder 3 is mounted in the base 6 the rear of the base 6 bears upon the holder in three general locations. The three locations include the leg 35a, leg 35b, and the rear shank surface 41. The rear shank surface 41 bears upon the base 6 at the lower rear base surface 61. Referring to FIG. 4 shows that the engagement between surfaces 41 and 61 does not restrict vertical travel of the holder within the base 6 during clamping. The threaded bolt 9 engages corresponding threaded portions of the bore 71 as a means for providing a rearward clamping force on the holder shank front load bearing surface 42. As the clamping bolt 9 is forceably rotated inward within bore 71 the pressure exerted on surface 42 causes the holder 3 to move rearward until all three of the previously mentioned supporting locations have been engaged. The parallel arrangement of surfaces 41 and 42 allow the legs 35a and 35b to properly seat within the notches formed by surfaces 66*a* and 67*a*, and 66*b* and 67*b* respectively. When the holder is firmly secured within the base 6 the clamping bolt 9 can be locked in place by nut 10.

Figure 3:
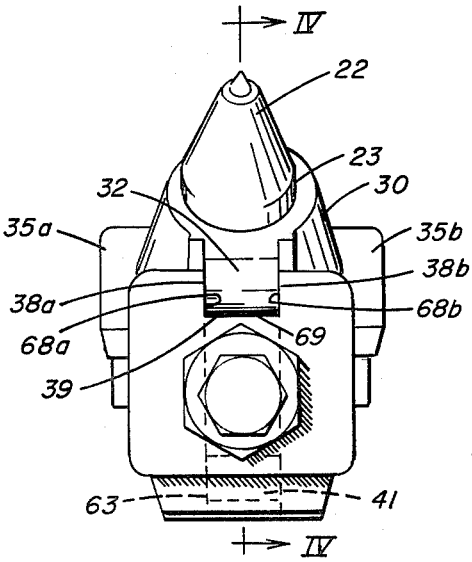
FIG. 3 is a front elevational view of the assembly of FIG. 2 with the socket and holder shank portion shown in partial phantom.

The clamping force exerted by the bolt 9 is directed along a line which passes through the triangulation formed by the three positions of rear support of the holder, namely leg 35*a*, leg 35*b*, and the rear shank support surface 61. The clamping bolt 9 is positioned so that the clamping force transmitted by the bolt 9 lies in a plane which passes between the holder legs 35*a* and 35*b*. FIG. 3 shows that the clamping bolt 9 is positioned above the rear shank surface 41, and below the load bearing surfaces on legs 35*a* and 35*b*.

Figure 5:
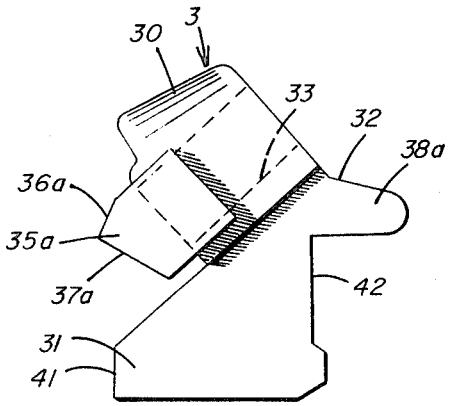
FIG. 5 is a side elevational view of the holder.

Referring to FIG. 5 a forward extension portion 32 of the holder 3 extends intermediate from and forward of the holding portion 30 and the shank portion 31. This forward extension portion provides for transmitting forces between the base 6 and the holder 3 at a further distance from the centerline A of the holder shank portion 31, than is available in a conventional bit holder system. Support forces may be exerted upon the side surfaces 38*a* and 38*b* of the forward extension 32 so as to inhibit rotation of the holder about the axis A of the socket 63. Referring to FIG. 3 shows the forward extension 32 having a right side surface 38*a* and a left side surface 38*b* which are mated to contact corresponding load bearing surfaces 68*a*, 68*b* on the holder 6. Surface 38*a* contacts surface 68*a* and surface 38*b* contacts load bearing surface 68*b*. In manufacturing the tolerances between the surfaces 38 and surfaces 68 are held to a minimum, such as for example 0.010 or less. When these tolerances are so minimized, the surfaces in effect retard rotation of the holder about its axis. As can be seen a portion of the forward extension 32 resides within a channel 62 extending forward from the socket in the base 6. This upwardly open channel 62 is formed by surfaces 68*a*, 68*b*, and 69 on the base 6. The forward extension 32 in addition to providing load bearing surfaces for engagement with corresponding base surfaces which provide forces to retard or inhibit rotation of the holder within the base 6, also provides additional upward support to the holder by the corresponding engagement between the lower forward extension surface 39 and the channel lower surface 69. The engagement of surfaces 39 and 69 permit the base 6 to provide upward support forces to the holder 3. The upward support forces on the forward extension 32 counter the normal force F2. In referring to FIG. 4 it can be seen the engagement between surfaces 39 and 69 provide upward support forces which are directly below forward portion of the bit formed by the bit cone 22 or bit tip 21. The forward positioning of the extension 32 provide for directly balancing force F2 without introducing any additional torque resulting from the force couple of F2 and the upward support forces on surface 39.

In the embodiment shown in FIGS. 8 and 9 the base 6 and the holder 3 have been configurated so that when the legs 35*a* and 35*b* are properly seated in their respective base positions and the surfaces 41 and 61 are contacting each other, a minimal space 16 is formed between the forward extension 32 and the channel 62. The sides of the channel 68*a* and 68*b* are contacting the respective sides of the forward extension 38*a* and 38*b*. By allowing the space 16 between surfaces 69 and 39 proper seating at the legs 35*a*, 35*b* and rear surface 41 are ensured because the holder is free to move both rearward and in a vertical direction as the clamping bolt is tightened. In practice it is found that if the vertical spacing between surfaces 39 and 69 is equal to or less than 0.02 inches this gap will quickly fill with particles of the mined material such as for example coal dust, and therefore provide a means of upward support to the forward extension 32. By intentionally maintaining a small tolerance between surfaces 62 and 42 the advantages of a tight initial contact between the legs 35*a* and 35*b* in the base are realized, and in addition after a short period of operation the space 16 becomes compacted with coal dust and functions as a solid support between surfaces 62 and 42. As can be seen from the drawings the axes of the bore, the shank portion, the bit shaft and the socket all generally lie in a vertical plane that bisects the mounting assembly.

While the primary cutting forces F1 and F2 have previously been described other forces are exerted on the cutter bit during mining operations. FIG. 8 shows side forces F4 and F3. These side forces are present during lateral movement of the bit. Such lateral forces are present during cutting or cross cutting with the miner drum. Additional side forces are present when the cutter bit assembly is mounted on a drum with the axis of the bit extending at an angle from the plane which passes through the bit tip and intersects the axis of the drum perpendicularly. During normal operation of the cutting bit one cause of the side forces F3 and F4 is due to varying consistency of the mined material. The magnitudes of forces F3 and F4 can vary rapidly over a wide range. Such rapidly varying would tend to cause oscillation or chattering of the bit holder within the bit block. Such sustained oscillatory movement cause excessive wear or premature breakage of the holder. As can be seen in FIGS. 3 and 8 the engagement of the side surfaces 38*a* and 38*b* on extension 32 by the inner surfaces 68*a* and 68*b* of the channel 62 in the base 6 provide substantial resisting forces at a forward position or moment from the axis A. As can be seen in FIG. 4 the forward extension portion 32 provides the longest moment about axis A of any surface on the holder which resists rotation about the axis A. While the open socket 63 is of rectangular horizontal cross sectional and the shank portion 31 of the holder 3 is of generally congruent rectangular horizontal cross section it is not necessary that the lateral surfaces of the holder shank 31 engage the inner side surfaces of the socket 63. By maintaining a tolerance between the side surfaces of the holder shank portion 31 and the inner side portions of the socket 63, holders 3 and base units 6 are readily interchangeable. Such interchangeability is highly desirable because during the life of a given base 6 many holders will be worn and require replacement.

Figure 6:
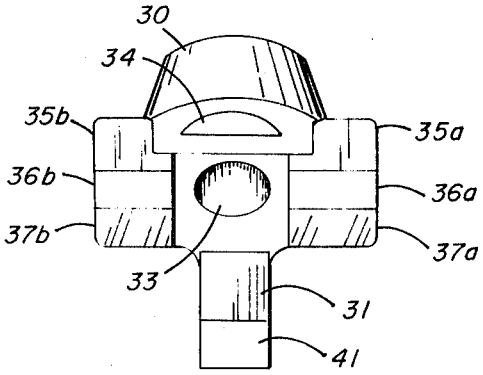
FIG. 6 is a rear elevational view of the holder shown in FIG. 5.

FIGS. 5 and 6 show the holder 3 with forward extension 32 and bore 33. FIGS. 7*a*, *b*, and *c* show an embodiment of a holder 3' having a forward extension 32 and a support tongue 40. The tongue 40 extends upward and rearward from the holder shank portion 31. The upwardly forward facing tongue surface 46 is a load bearing surface which contacts the rear surface 26 of the bit to provide additional support for the bit in an axial direction. Surface 46 is a planar surface lying within a circular area having a radius equal to the radius of the bore 33 and having a center lying along the extension of the axis of the bore 33. This additional support from surface 46 acts against F5. As can be seen in FIG. 7*a* bits having a shaft 24 of a shaft length less than the distance from the holder annular surface 45 to the tongue surface 46 may be used. As shown in FIG. 7*a*, bit flange 23 is used to transmit the downward axial forces from the bit 2 to the bit holder 3. In the embodiment shown in FIG. 7*a* a rear clearance 17 is shown between the rear surface on the bit 26 and the tongue surface 46. For some specific mining applications where bit shaft rotation is a problem this method is desirable.

FIG. 7*b* shows a bit 2' having a shaft 24' aligned within bore 33 of the holder 3'. The geometry between shaft 24' and the holder 3' is such that simultaneous contact between the bit annular surface 25 and the holder annular surface 45, and the bit rear surface 26' and the tongue surface 46 respectively. As can be seen the bearing surfaces on the bit and the holder which provide support to forces directed parallel to the axis of the bit shaft 24 and the bore 33, namely surfaces 25, 45, 46 and 26 lie in planes which are generally perpendicular to the axis of said shaft. Surfaces lying in such perpendicular planes efficiently transmit the primary cutting forces from the bit to the holder. Having the holder contact the bit at both the flange 23 and the rear surface 26 increases the area of contact between the two pieces and thereby reduce the frictional wear during rotation of the bit.

Referring to FIG. 7*c* shows a pencil type bit 13 in a bit holder 3'. This bit has a bit shaft portion 14 which is of generally uniform circular cross sectional area. The bit shaft 14 is free to rotate within the bore 33. The primary cutting forces are transmitted along the axis of the bit 13 to the interface between the rear bit surface 26' and the tongue surface 46. The engagement between surfaces 26' and 46 support the bit 13 against rearward axial movement within the bore 33.

As can be seen by referring to FIGS. 7*a, b* and *c* when a bit holder of the type 3' is used cutting bits of various types may be used interchangeably with the same bit holder 3'. This interchangeability is important in mine operation as different cutting bits may be used in the mining machine for different operations without changing the bit bases or bit holders. In addition, if a mine operation is using a specific type of bit which is temporarily unavailable he may substitute a variety of cutter bits in his existing bit holders, thereby avoiding the necessity to change bit holders or bases.

Referring to FIG. 10 shows a top view of the bit, holder and base assembly similar to that shown in FIG. 2. The axis A' of the holder shank portion is indicated at its intersection with the axis of the bit. The axis A and the axis A' generally coincide. It can be seen that the forward extension 31 is fitted within the channel 62. The support forces provided by the engagement of the forward extension 32 and the channel 62 can be seen to be acting at a considerable distance or moment from the axis A'. In addition, it can be seen that the forward extension 32 is positioned beneath the bit tip 21 and the forward portion of the bit cone 22; which results in the upward support provided by the engagement of surfaces 39 and 69 to be directed along the same line as but opposing the normal force F2.

While the invention has been described in conjunction with specific embodiments thereof it is evident that there are many alternatives, modifications, and variations apparent to those skilled in the art in view of the foregoing descriptions. Accordingly, this application is intended to embrace all such alternatives, modifications and variations as fall within the spirit and scope of the appended claims.

What is claimed is:

1. An assembly for mounting a cutter bit on a driven mechanism comprising:
a bit holder;
said bit holder having a bore adapted to receive a cutter bit;
a shank portion of said holder having at least one rear load bearing surface disposed on the rear of said shank portion;
at least one front load bearing surface disposed on the front of said shank portion of said holder;
a cutter base having an upwardly open socket;
said socket receiving at least a part of said shank portion of said holder;
said socket having at least one base load bearing surface to contact said rear load bearing surface;
said socket having at least one clamping means on said base for exerting a rearward force to said front load bearing surface;
said holder having a forward extension portion extending further forward than said front load bearing surface; and
said base having load bearing means in substantially abuting relationship with said forward extension for substantially fixing said holder from rotation about the axis of the socket.

2. The assembly of claim 1 wherein said load bearing means being so configurated to permit rearward movement of said extension portion relative to said base.

3. The assembly of claim 1 further including:
at least two outwardly facing opposing surfaces on said extension portion lying in planes generally parallel to the plane generally formed by the axes of said bore and said shank; and
said load bearing means further including at least two opposing inwardly facing surfaces generally parallel to the plane generally formed by the axes of said bore and said socket.

4. The assembly of claim 1 wherein said load bearing means includes an open channel in the upper surface of said base extending forward from said socket.

5. The assembly of claim 1 further comprising:
at least one load bearing surface on said base upwardly contacting said forward extension.

6. The assembly of claim 1 further comprising:
at least one downward facing surface on said forward extension lying in a plane that generally perpendicularly intersects the axis of the shank;
at least one upward facing surface of said base lying in a plane that generally perpendicularly intersects the axes of said socket; and
said upward facing surface lying in parallel spaced relationship from said downward facing surface.

7. The assembly of claim 6 wherein said spaced relationship between said upward facing surface and said downward facing surface is less than 0.02 inch.

8. The assembly of claim 1 further comprising:
at least one downward facing surface on said forward extension lying in a plane that generally perpendicularly intersects the axis of the shank; and
at least one upward facing surface on said base lying in a plane that generally perpendicularly intersects the axes of said socket and contacts said downward facing surface.

9. The assembly of claim 1 wherein said bit holder further including a first annular load bearing surface on the forward portion of said holder;
said first annular load bearing surface being concentric about the axis of said bore; and said first annular surface lying in a forward facing plane generally perpendicular to the axis of said bore.

10. The assembly of claim 9 further comprising:

a conical cutter bit;

said bit having a bit shaft portion axially aligned within said bore in said bit holder;

said bit having a generally conical tip portion;

said bit having a second annular load bearing surface intermediate said bit shaft portion and said tip portion;

said second annular surface being concentric about the axis of said shaft portion; and said second annular surface lying in a plane generally perpendicular to the axis of said bit shaft portion; and said second annular surface being rearward facing to engage said first annular surface.

11. An assembly for mounting a cutter bit on a driven mechanism comprising:

a bit holder having a shank portion;

said bit holder having a bore adapted to receive a cutter bit;

a bit support tongue portion on said holder extending generally upwardly from said shank portion and having a generally upwardly facing load bearing surface which is oriented in a plane that is generally perpendicular to the axis of said bore;

a said shank portion of said holder having at least one rear load bearing surface disposed on the rear of said shank portion;

at least one front load bearing surface disposed on the front of said shank portion of said holder;

a cutter base having an upwardly open socket;

said socket receiving at least a part of said shank portion;

said socket having at least one base load bearing surface to contact said rear load bearing surface;

said base having at least one clamping means for exerting a rearward force to said front load bearing surface;

said holder having a forward extension portion extending further forward than said front load bearing surface; and said base having load bearing means in substantially abuting relationship with said forward extension for substantially fixing said holder from rotation about the axis of the socket.

12. The assembly of claim 11 further comprising:

a conical bit having a tip portion and a bit shaft portion;

said bit shaft portion being axially aligned within said bore in said holder; and said bit shaft portion having a rearward facing load bearing surface lying in a plane generally perpendicular to the axis of said bit shaft portion and contacting said load bearing surface on said tongue portion.

13. The assembly of claim 11 wherein at least a portion of said upwardly facing load bearing surface lies within a first circular shaped planar area said circular area having a diameter equal to the diameter of said bore and a center on the extension of the axis of said bore;

and said bit holder has a first annular load bearing surface on the forward portion of said holder;

said first annular load bearing surface being concentric about the axis of said bore; and said first annular surface lying in a forward facing plane generally perpendicular to the axis of said bore.

14. The assembly of claim 13 further comprising:

a conical bit;

said bit having a bit shaft portion axially aligned within said bore in said bit holder;

said bit having a generally conical tip portion;

said bit having a second annular load bearing surface intermediate said bit shaft portion and said tip portion;

said second annular surface being concentric about the axis of said shaft portion;

said second annular surface lying in a plane generally perpendicular to the axis of said bit shaft portion;

and said second annular surface being rearward facing to engage said first annular surface.

15. The assembly of claim 14 wherein:

said bit shaft portion has a rearward facing load bearing second surface lying in a plane generally perpendicular to the axis of said bit shaft portion; and said second surface positioned to engage said upward facing load surface.

16. An assembly for mounting a cutter bit on a driven mechanism comprising:

a bit holder having a body portion;

said bit holder having a bore adapted to receive a cutter bit;

a shank portion of said holder having at least one rear load bearing surface disposed on the rear of said shank portion;

at least one front load bearing surface disposed on the front of said shank portion of said holder;

at least two legs extending generally rearwardly from said body portion of said holder;

at least two load bearing surfaces on the rear portion of said base contacting said legs;

said cutter base having an upwardly open socket;

said socket receiving at least a part of said shank portion;

said socket having at least one base load bearing surface to contact said rear load bearing surface;

said socket having at least one clamping means on said base for exerting a rearward force to said front load bearing surface;

said holder having a forward extension portion extending further forward than said front load bearing surface; and said base having load bearing means in substantially abuting relationship with said forward extension for substantially fixing said holder from rotation about the axis of the socket.

17. The assembly of claim 16 wherein said load bearing means being so configurated to permit rearward movement of said extension portion relative to said base.

18. The assembly of claim 17 wherein said load bearing means includes an upwardly open channel in the upper surface of said base extending forward from said socket.

19. The assembly of claim 16 further including:

at least two outwardly facing opposing surfaces on said extension portion lying in planes generally parallel to the plane generally formed by the axes of said bore and said shank;

and said load bearing means further including at least two inwardly facing opposing surfaces generally parallel to the plane generally formed by the axes of said bore and said socket.

20. The assembly of claim 19 further comprising:

at least one load bearing surface on said base upwardly contacting said forward extension.

21. The assembly of claim 19 further comprising:

at least one downward facing surface on said forward extension lying in a plane that generally perpendicularly intersects the axis of the shank; and at least one upward facing surface on said base lying in a plane that generally perpendicularly intersects the axes of said socket; and said upward facing surface lying in parallel spaced relationship from said downward facing surface.

22. The assembly of claim 21 wherein said spaced relationship between said upward facing surface and said downward facing surface is less than 0.2 inch.

23. The assembly of claim 19 further comprising:

at least one downward facing surface on said forward extension lying in a plane that generally perpendicularly intersects the axis of the shank; and at least one upward facing surface on said base lying in a plane that generally perpendicularly intersects the axes of said socket and contacting said downward facing surface.

24. The assembly of claim 19 wherein said bit holder further including a first annular load bearing surface on the forward portion of said holder;

said first annular load bearing surface being concentric about the axis of said bore; and said first annular surface lying in a forward facing plane generally perpendicular to the axis of said bore.

25. The assembly of claim 24 further comprising:

a conical cutter bit;

said bit having a bit shaft portion axially aligned within said bore in said bit holder;

said bit having a generally conical tip portion;

said bit having a second annular load bearing surface intermediate said bit shaft portion and said tip portion;

said second annular surface being concentric about the axis of said shank portion; and said second annular surface lying in a plane generally perpendicular to the axis of said bit shaft portion; and said second annular surface being rearward facing to engage said first annular surface.

26. An assembly for mounting a cutter bit on a driven mechanism comprising:

a bit holder;

said bit holder having a bore adapted to receive a cutter bit;

a shank portion of said holder having at least one rear load bearing surface disposed on the rear of said shank portion;

at least one front load bearing surface disposed on the front of said shank portion of said holder;

a bit support tongue portion on said holder;

said tongue extending generally upwardly from said shank portion and having a generally upwardly forward facing load bearing surface which is oriented generally perpendicular to the axis of said bore;

at least two legs extending generally rearward from said body portion of said holder;

a cutter base having an upwardly open socket;

said socket receiving at least a part of said shank portion;

said socket having at least one base load bearing surface to contact said rear load bearing surface;

said base having at least one clamping means for exerting a rearward force to said front load bearing surface;

said holder having a forward extension portion extending further forward than said front load bearing surface;

a least two load bearing surfaces on the rear portion of said base engaging said legs; and said base having load bearing means in substantially abuting relationship with said forward extension for substantially fixing said holder from rotation about the axis of the socket.

27. The assembly of claim 26 wherein said load bearing means being so configurated to permit rearward movement of said extension portion relative to said base.

28. The assembly of claim 26 wherein said load bearing means includes an open channel in the upper surface of said base extending forward from said socket.

29. The assembly of claim 26 further including:

at least two outwardly facing opposing surfaces on said extension portion lying in planes generally parallel to the plane generally formed by the axes of said bore and said shank;

and said load bearing means further including at least two inwardly facing opposing surfaces generally parallel to the plane generally formed by the axes of said bore and said socket.

30. The assembly of claim 29 further comprising:

at least one load bearing surface on said base upwardly contacting said forward extension.

31. The assembly of claim 29 further comprising:

at least one downward facing surface on said forward extension lying in a plane that generally perpendicularly intersects the axis of the shank; and at least one upward facing surface on said base lying in a plane that generally perpendicularly intersects the axes of said socket; and said upward facing surface lying in parallel spaced relationship from said downward facing surface.

32. The assembly of claim 31 wherein said spaced relationship between said upward facing surface and said downward facing surface is less than 0.02 inch.

33. The assembly of claim 29 further comprising: at least one downward facing surface on said forward extension lying in a plane that generally perpendicularly intersects the axis of the shank; and at least one upward facing surface on said base lying in a plane that generally perpendicularly intersects the axes of said socket and contacts said downward facing surface.

34. The assembly of claim 29 wherein said bit holder further including a first annular load bearing surface on the forward portion of said holder;

said annular load bearing surface being concentric about the axis of said bore; and said annular surface lying in a forward facing plane generally perpendicular to the axis of said bore.

35. The assembly of claim 34 further comprising:

a conical cutter bit;

said bit having a bit shaft portion axially aligned within said bore in said bit holder;

said bit having a generally conical tip portion;

said bit having a second annular load bearing surface intermediate said bit shaft portion and said tip portion;

said second annular surface being concentric about the axis of said shaft portion;

said second annular surface lying in a plane generally perpendicular to the axis of said bit shaft portion; and said second annular surface being rearward facing to engage said first annular surface.

36. The assembly of claim 35 wherein said bit shank portion has a generally rearward facing load bearing surface lying in a plane generally perpendicular to the axis of said bit shank portion and contacting at least a portion of said load bearing surface on said tongue portion.

37. In a mining cutter assembly wherein a cutter bit is received in a bit holder such bit holder having a forward extension and such bit holder being mounted in an upwardly open bit holder socket in a base member such base member comprising:

at least one generally forwardly facing load bearing surface disposed adjacent the bottom of said socket;

at least one clamping means operably associated with said base for exerting rearward clamping forces within said socket; and said base having load bearing means in substantially abuting relationship with said forward extension for substantially fixing said holder from rotation axis of the socket.

38. The base member of claim 37 wherein said load bearing means includes:

at least two inwardly facing and opposing surfaces on said base lying in planes generally parallel to a plane vertically bisecting said socket.

39. The base member of claim 37 wherein said load bearing means is positioned generally above a part of said clamping means.

40. The base member of claim 37 further including:

at least two load bearing surfaces on the rear portion of said base facing generally forwardly and downwardly; and at least two load bearing surfaces on the rear portion of said base facing generally forwardly and upwardly.

41. The base member of claim 40 wherein said load bearing means further includes at least two inwardly facing load bearing surfaces lying in planes generally parallel to the plane vertically bisecting said socket and said surfaces lie in planes that pass intermediate said forward and downward facing load bearing surfaces.

42. The base member of claim 37 wherein said load bearing means includes an upwardly open channel in the upper surface of said base extending forward from said socket.

43. The base member of claim 37 wherein said clamping means includes a threaded bore portion in said base; and a clamping bolt having threads engaging said threaded bore portion.

44. The base member of claim 37 wherein said socket has a generally rectangular cross-section having at least two sides oriented generally parallel to a plane vertically bisecting said socket.

45. The base member of claim 42 wherein said channel includes two inwardly facing load bearing surfaces lying in opposing planes generally parallel to the plane that vertically bisects said socket.

46. The base member of claim 45 further including an upwardly facing load support surface intermediate said two inwardly facing load bearing surfaces; and said upwardly facing surfaces generally lying in a plane that perpendicularly intersects the axis of said socket.

47. The assembly of claim 46 wherein said clamping means includes a threaded bore portion in said base; and a clamping bolt having threads engaging said threaded bore portion.

48. A cutter bit holder for securing a cutter bit to a socket type base mounted on a driven mechanism comprising:

a body portion;

said body portion having a cutter bit receiving bore;

a shank portion;

at least one rear load bearing surface disposed on the rear of said shank portion;

at least one front load bearing surface disposed on the front on said shank portion;

a forward extension portion on the front of said holder extending forward of said shank portion; and said forward extension having load bearing means for substantially fixing said holder within such socket from rotation about the axis of said shank portion.

49. The bit holder of claim 48 further comprising:

said load bearing means having at least two outwardly facing load bearing surfaces on said extension portion; and said outwardly facing surfaces lying in planes generally parallel to the plane formed by the axes of said bore and said shank portion.

50. The bit holder of claim 48 further comprising at least one generally downwardly facing surface on said forward extension lying in a plane that generally perpendicularly intersects the axis of said shank portion.

51. The bit holder of claim 48 wherein said shank portion if of generally rectangular transverse cross section.

52. The bit holder of claim 48 wherein said body portion includes a first annular load bearing surface on the forward portion of said holder;

said first annular load bearing surface being concentric about the axis of said bore; and said first annular surface lying in a forward facing plane generally perpendicular to the axis of said bore.

53. The bit holder of claim 52 further including:

a cutter bit;

said bit having a shaft portion axially aligned within said bore in said bit holder;

said bit having a generally conical tip portion;

said bit having a second annular load bearing surface intermediate said bit shaft and said tip portion;

said second annular surface being concentric about the axis of said shaft portion;

said second annular surface lying in a plane generally perpendicular to the axis of said bit shaft portion; and said second annular surface being rearward facing to engage said first annular surface.

54. The bit holder of claim 48 which further includes:

a bit support tongue portion generally intermediate said shank portion and said body portion on the rear side of said holder;

said tongue portion extending generally upward from said shank portion;

said tongue portion having an upward facing load bearing surface lying in a plane which intersects the axis of said bore; and said upwardly facing surface on said tongue portion lying in a plane that is oriented generally perpendicular to the axis of said bore.

55. The bit holder of claim 54 further comprising:

a conical bit having a tip portion and a bit shaft portion;

said bit shaft portion being axially aligned within said bore in said holder; and said bit shaft portion having a rearward facing load bearing surface lying in a plane generally perpendicular to the axis of said bit shaft portion and contacting said load bearing surface on said tongue portion.

56. The bit holder of claim 54 wherein at least a portion of said upwardly facing load bearing surface lies within a first circular shaped planar area said circular area having a diameter equal to the diameter of said bore and a center on the extension of the axis of said bore;

said bit holder has a first annular load bearing surface on the forward portion of said holder;

said annular load bearing surface being concentric about the axis of said bore;

and said first annular surface lying in a forward facing plane generally perpendicular to the axis of said bore.

57. The bit holder of claim 56 further comprising:

a conical bit;

said bit having a bit shank portion axially aligned within said bore in said bit holder;

said bit having a generally conical tip portion;

said bit having a second annular load bearing surface intermediate said bit shank portion and said tip portion;

said second annular surface being concentric about the axis of said shank portion;

said second annular surface lying in a plane generally perpendicular to the axis of said bit shank portion;

said second annular surface being rearward facing to engage said first annular surface;

said bit shank portion has a rearward facing load bearing second surface lying in a plane generally perpendicular to the axis of said bit shank portion; and the distance from the plane of said second surface on said bit shank to the plane of said second annular surface on said bit generally equals the distance from the plane of said first circular surface on said holder to the plane of said first annular surface on said bit holder.

58. A cutter bit holder for securing a cutter bit to a socket type base mounted on a driven mechanism comprising:

a body portion;

said body portion having a cutter bit receiving bore;

a shank portion;

at least one rear load bearing surface disposed on the rear of said shank portion;

at least one front load bearing surface disposed on the front on said shank portion;

at least two legs extending generally rearwardly from said body portion; and a forward extension portion on the front of said holder forward of said shank portion.

59. The bit holder of claim 58 further comprising:

said load bearing means having at least two outwardly facing load bearing surfaces on said extension portion; and said outwardly facing surfaces lying in planes generally parallel to the plane formed by the axes of said bore and said shank portion.

60. The bit holder of claim 58 further comprising at least one generally downwardly facing surface on said forward extension lying in a plane that generally perpendicularly intersects the axis of said shank portion.

61. The bit holder of claim 58 wherein said shank portion is of generally rectangular transverse cross section.

62. The bit holder of claim 58 wherein said body portion includes a first annular load bearing surface on the forward portion of said holder;

said first annular load bearing surface being concentric about the axis of said bore; and said first annular surface lying in a forward facing plane generally perpendicular to the axis of said bore.

63. The bit holder of claim 62 further including:

a cutter bit;

said bit having a shaft portion axially aligned within said bore in said bit holder;

said bit having a generally conical tip portion;

said bit having a second annular load bearing surface intermediate said shaft portion and said tip portion;

said second annular surface being concentric about the axis of said shaft portion;

and said second annular surface being rearward facing to engage said first annular surface.

64. The bit holder of claim 59 further including:

at least one generally downwardly facing surface on said forward extension lying in a plane that generally perpendicularly intersects the axis of said shank portion;

wherein said shank portion is of generally rectangular transverse cross section;

each of said legs having a first surface facing generally rearwardly and generally downwardly;

each of said legs having a second surface facing generally rearwardly and generally upwardly;

said body portion includes a first annular load bearing surface on the forward portion of said holder;

said first annular load bearing surface being concentric about the axis of said bore; and said first annular surface lying in a forward facing plane generally perpendicular to the axis of said bore.

65. The bit holder of claim 58 further including:

a bit support tongue portion generally intermediate said shaft portion and said body portion on the rear side of said holder;

said tongue portion extending generally upward from said shank portion;

said tongue portion having an upward facing load bearing surface lying in a plane which intersects the axis of said bore; and said upwardly facing surface on said tongue portion lying in a plane that is oriented generally perpendicular to the axis of said bore.

66. The assembly of claim 65 further comprising:

a conical bit having a tip portion and a bit shaft portion;

said bit shaft portion being axially aligned within said bore in said holder; and said bit shaft portion having a rearward facing load bearing surface lying in a plane generally perpendicular to the axis of said bit shank portion and contacting said load bearing surface on said tongue portion.

67. The assembly of claim 65 wherein at least a portion of said upwardly facing load bearing surface lies within a first circular shaped planar area said circular area having a diameter equal to the diameter of said bore and a center on the extension of the axis of said bore;

said bit holder has a first annular load bearing surface on the forward portion of said holder;

said first annular load bearing surface being concentric about the axis of said bore; and said first annular surface lying in a forwardly facing plane generally perpendicular to the axis of said bore.

68. The assembly of claim 67 further comprising:

a conical bit;

said bit having a bit shaft portion axially aligned within said bore in said bit holder;

said bit having a generally conical tip portion;

said bit having a second annular load bearing surface intermediate said bit shaft portion and said tip portion;

said second annular surface being concentric about the axis of said shaft portion;

said second annular surface lying in a plane generally perpendicular to the axis of said bit shaft portion; and said second annular surface being rearward facing to engage said first annular surface.

69. The bit holder of claim 65 further including:

said load bearing means having at least two outwardly facing load bearing surfaces on said extension portion;

said outwardly facing surfaces lying in planes generally parallel to the plane formed by the axes of said bore and said shank portion;

each of said legs having a first surface facing generally rearwardly and generally downwardly;

each of said legs having a second surface facing generally rearwardly and generally upwardly;

at least one generally downwardly facing surface on said first extension lying in a plane that generally perpendicularly intersects the axis of said shank portion; and wherein said shank portion is of generally rectangular transverse cross section.

70. A cutter bit holder for securing a cutter bit to a socket type base mounted on a driven mechanism comprising:

a body portion;

said body portion having a cutter bit receiving bore;

said body portion having an annular load bearing surface on the forward section of said body portion;

said annular load bearing surface being concentric about the axis of said bore and lying in a forward facing place generally perpendicular to the axis of said bore;

a shank portion;

at least one rear load bearing surface disposed on the rear of said shank portion;

at least one load bearing surface disposed on the front of said shank portion;

a bit support tongue portion generally intermediate said shank portion and said body portion;

said tongue portion generally extending upward and rearward from said shank portion and orientated generally perpendicular to the axis of said bore;

and said tongue portion having an upwardly facing load bearing surface said surface lying in a plane which generally perpendicularly intersects the axis of said bore.

71. The assembly of claim 70 wherein said holder further includes:

at least two rearwardly extending legs;

each of said legs having a first surface facing generally rearwardly and downwardly; and each of said legs having a second surface facing generally rearwardly and upwardly.

72. A conical cutter bit for attachment to a driven mining mechanism comprising:

a shaft uniform circular cross section;

a generally conical shaped tip portion extending from one end of said shaft portion;

an annular load bearing surface intermediate said shaft portion and said tip portion;

said annular surface being concentric about about the axis of said shaft portion;

the inner diameter of said annular surface being generally equal to the diameter of said shaft portion;

said annular surface lying in a plane generally perpendicular to the axis of said shaft portion;

said annular surface facing generally away from said tip portion;

said shaft portion having a second load bearing surface on the end of said shaft portion opposite said tip portion;

said second surface lying in a plane generally perpendicular to the axis of said shaft portion; and said second surface facing generally away from said tip portion.

* * * * *

UNITED STATES PATENT AND TRADEMARK OFFICE

CERTIFICATE OF CORRECTION

PATENT NO. : 4,240,669

DATED : December 23, 1980

INVENTOR(S) : Lester G. Rollins

It is certified that error appears in the above-identified patent and that said Letters Patent are hereby corrected as shown below:

Col. 2, line 37 delete "up" and insert -- upon --.

Col. 4, line 38 delete "obect" and insert -- object --.

Col. 5, line 65 delete "top" and insert -- tip --.

Col. 6, line 17 delete "result" and insert -- results --.

Col. 9, line 50, delete "31" and insert -- 32 --.

Col. 16, line 39 delete "if" and insert -- is --.

Col. 20, line 8 delete "place" and insert -- plane --.

Col. 20, line 33 after "shaft" insert -- portion of --.

Col. 20, line 38 delete "about" second occurrence.

Signed and Sealed this

*Seventeenth* Day of *March 1981*

[SEAL]

*Attest:*

RENE D. TEGTMEYER

*Attesting Officer* *Acting Commissioner of Patents and Trademarks*